United States Patent [19]

Cailliau et al.

[11] 4,454,802

[45] Jun. 19, 1984

[54] PISTON ASSEMBLY FOR A FLUID MECHANISM WITH REACTION PLATE, COMPLETE WITH SLIPPER BLOCK

[75] Inventors: Gérard M. Cailliau, Compiegne; Jean-Pol Mathieu, Villers Sous Saint Leu, both of France

[73] Assignee: Poclain Hydraulics, France

[21] Appl. No.: 311,314

[22] Filed: Oct. 14, 1981

[30] Foreign Application Priority Data

Oct. 28, 1980 [FR] France ..... 80 23030

[51] Int. Cl.[3] ..... F01B 31/10; F01B 13/04

[52] U.S. Cl. ..... 92/158; 92/172; 92/260; 91/488

[58] Field of Search ..... 92/58, 256, 258, 260, 92/172, 158; 91/488, 491, 492, 497, 498

[56] References Cited

U.S. PATENT DOCUMENTS

| | | | |
|---|---|---|---|
| 1,710,567 | 4/1929 | Carey | 91/488 |
| 2,299,235 | 10/1942 | Snader et al. | 91/488 |
| 2,483,856 | 10/1949 | Temple | 91/488 |
| 2,901,979 | 9/1959 | Henrichsen | 91/488 |
| 2,918,338 | 12/1959 | Grad | 92/157 |
| 3,291,068 | 12/1966 | Wiggermann | 91/488 |
| 3,319,575 | 5/1967 | Havers | 92/260 |
| 3,663,125 | 5/1972 | Freeman | 91/498 |
| 3,760,690 | 9/1973 | Freeman | 91/491 |
| 3,828,653 | 8/1974 | Aldinger et al. | 91/488 |

FOREIGN PATENT DOCUMENTS

| | | | |
|---|---|---|---|
| 646228 | 8/1962 | Canada | 91/488 |
| 35042 | 10/1929 | France . | |
| 980939 | 5/1951 | France . | |
| 1331904 | 6/1963 | France . | |
| 2094705 | 2/1972 | France . | |
| 436996 | 11/1967 | Switzerland . | |
| 638758 | 6/1950 | United Kingdom | 92/58 |

*Primary Examiner*—William L. Freeh
*Assistant Examiner*—Paul F. Neils
*Attorney, Agent, or Firm*—Lewis H. Eslinger

[57] ABSTRACT

The present invention relates to an assembly, for use in a pressurized fluid mechanism equipped with pistons bearing against a reaction plate by way of slipper blocks, which assembly consists in such a piston and the associated slipper block coupled to one end of said piston by means of a "ball and socket" type assembly, the male element of the assembly being constituted by that part of the slipper block facing the face supporting the said slipper block on the reaction plate. A bolt comprising a screw and nut, joins the slipper block to the piston, the supporting surfaces of the nut and of the screw head on the corresponding parts of the slipper head and of the piston being of the "ball and socket" type.

The invention finds an application in the production of high power hydraulic motors.

3 Claims, 3 Drawing Figures

PISTON ASSEMBLY FOR A FLUID MECHANISM WITH REACTION PLATE, COMPLETE WITH SLIPPER BLOCK

The invention relates to a piston assembly for a fluid mechanism with reaction plate, complete with slipper block.

Certain mechanisms, such as motors or pumps, working with pressurized fluids, have pistons which rest against a directionally-adjustable plate by means of slipper blocks, the piston and its associated block being joined together by a swivel assembly, the female element of the swivel being constituted by the end of the piston whereas the male element is constituted by a corresponding surface of the block.

In certain known assemblies, such as that shown in French Pat. No. 980 939 the slipper block is connected to the piston by a rod which, according to the prior art is, either clamped, and it can break under the effect of the forces to which it is subjected, or mounted with a non-adjustable play, and then it can also be damaged easily.

In order to overcome these drawbacks, it is important to design the slipper blocks so as to obtain maximum surfaces for the different parts to bear one on the other.

It is therefore the object of the invention to propose, in a pressurized fluid mechanism, such as a hydraulic pump or motor equipped, with pistons bearing against a reaction plate by way of slipper blocks, an assembly composed of such a piston and the slipper block associated thereto which latter is coupled to one end of the said piston by means of a "ball-and-socket" type joint, the male element of said joint being constituted by that part of the slipper block facing the face supporting said block on the reaction plate, and the female element being constituted by the said end of the piston, whereas, on the one hand, the piston comprises a central cavity issuing at its two axial ends and which is defined, on the side of the said piston end constituting the female element of the assembly, by a shoulder of smaller cross-section than the rest of said cavity, and on the other hand, the slipper block also comprises a cavity which issues on its contact face on the reaction plate, and, comprises a through hole, which connects the said cavity of the slipper block with its face constituting the male element of the assembly, and whereas a bolt is provided which comprises a screw, itself comprising a stem and a screw head, and a nut, the stem of said screw traversing the said holes provided on the piston shoulder and in the block, one of the parts of the bolt—whether screw head or nut—being introduced in the cavity of the slipper block and resting against the bottom thereof, and the complementary part of the bolt—nut or screw head—resting against the shoulder of the piston cavity.

The supporting surfaces for the nut and the screw head on the corresponding parts of the slipper block and of the piston are of the "ball and socket" type.

The following advantageous dispositions are also preferably adopted.

The nut is assembled on the screw in such a way as to leave an operational clearance permitting the free relative pivoting of the two elements of the block and piston assembly.

The nut is locked in position once the assembly is finally welded, using the electron beam method, on the cooperating ends of the screw thread and of the tapping of the nut.

The said through holes provided in the piston and in the slipper block, the screw head and stem, and the nut of the bolt, define an enclosure which a connecting pipe joins up to the piston cavity.

The conduit joining the enclosure to the piston cavity is provided in that part of the bolt assembly—screw stem, screw head, or nut—which is resting against the shoulder.

When the said complementary part of the bolt is resting against the shoulder via a bush which is introduced into the hole provided in said shoulder, and of which the head is interposed between the said shoulder and the said complementary part of the bolt, the pipe connecting the enclosure with the piston cavity is provided in said bush.

The invention will be more readily understood on reading the following description with reference to the accompanying drawings, in which.

Figure 1:
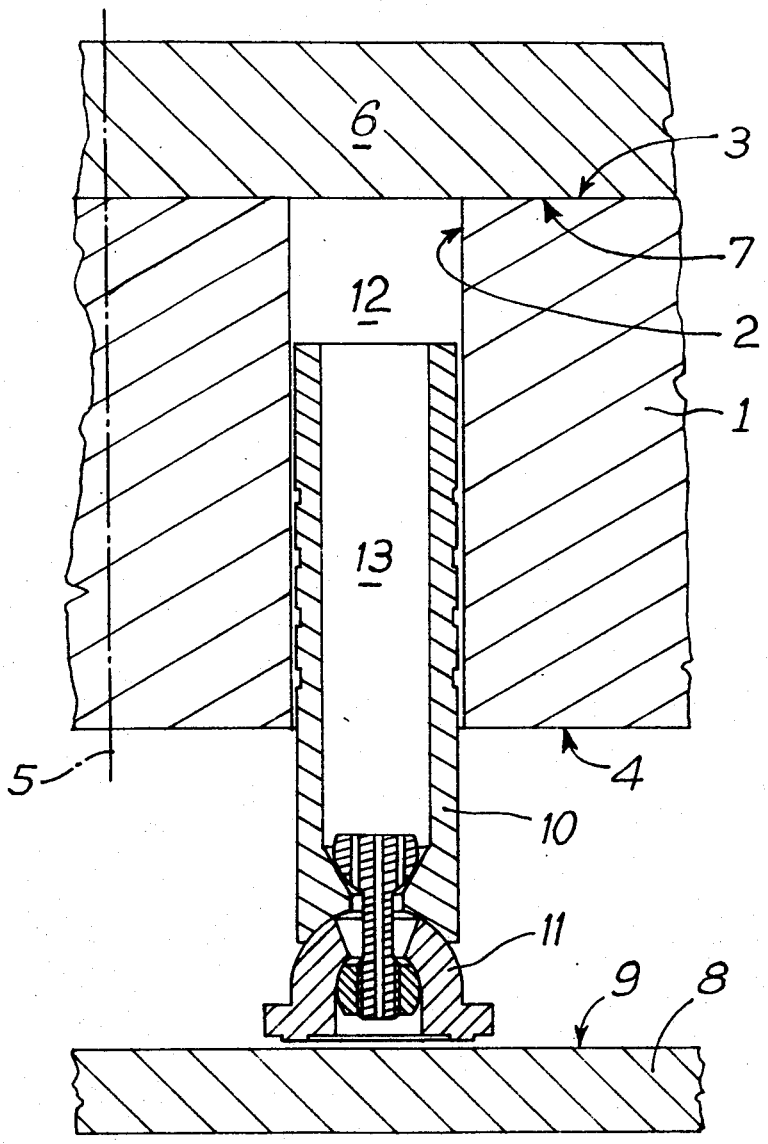
FIG. 1 is an axial cross-section of a hydraulic motor comprising an assembly according to the invention.

The mechanism shown in FIG. 1 is a hydraulic motor.

A cylinder block 1, in which are provided cylinders 2, and which is defined by two planes 3 and 4, perpendicular to the axis of rotation 5 of the said cylinder block.

A pressurized fluid valve-seat 6, one plane face 7 of which is resting against one, 3, of the planes defining the cylinder-block 1 and which, in addition, is fixed with respect to the casing of the motor.

A reaction plate 8 is inclinable with respect to the axis of rotation 5 and, on one face 9 of which, the pistons 10, mounted for sliding inside cylinders 2, are supported with interposition of slipper blocks 11.

A fact to be noted is the existence of chambers 12, defined in each cylinder 2, by said cylinder 2, the corresponding piston 10 and the valve-seat 6. Moreover, each piston 10 comprises a central cavity 13 which issues into the said chamber 12.

The assembly of the slipper block 11 with the piston 10 will now be described with reference to FIGS. 2 and 3.

Figure 2:
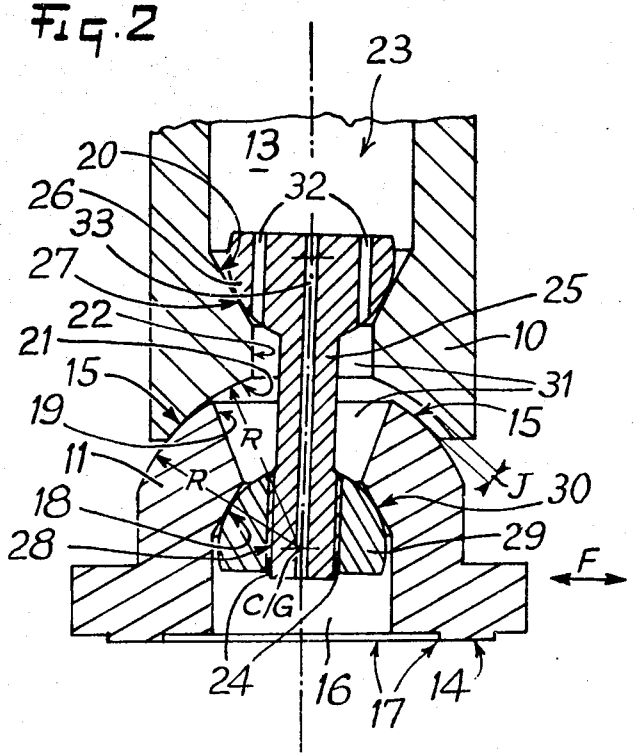
FIG. 2 is an enlarged view of a detail of the assembly of FIG. 1.

Referring first to FIG. 2, the following characteristics are noted.

The slipper block has:

a plane face 14 which is in resting contact on the face 9 of the plate 8, with interposition between these two faces of a film of oil (contained in the clearance shown in FIG. 1), a spherical face 15 which faces the plane face 14, is convex and constitutes the male element of the assembly with the piston 10, an inner cavity 16 issuing onto the plane face 14 via an orifice 17, and presenting, facing the orifice 17, a truncated face 18 convergent in the direction going away from the said orifice 17, a conduit 19, connecting the truncated face 18 to the spherical face 15, and , a distribution of the masses such that the centre of gravity G of the slipper block coincides with the centre C of the spherical face 15.

The piston 10 is designed so that:

its central cavity 13 narrows towards that end of said piston which is close to the slipper block 11, to constitute a shoulder 20, which in the illustrated case is truncated, its end transverse face 21 is spherical, concave, and has the same radius R as the face 15 of the slipper block 11 and faces the spherical face 15 of the slipper block 11, and, A conduit 22 connects the truncated face of the shoulder 20 to the spherical concave face 21.

A bolt 23 joins together the slipper block 11 and the piston 10 and is constituted by:

a screw, whose stem 25 traverses the conduits 22 and 19 whose head 26 rests by its spherical convex face 27 on the shoulder 20 whilst being contained inside the cavity 13 of the piston, and, whose thread 28 issues into the cavity 16 of the slipper block 11, and a nut 29, which is contained in the cavity 16 of the slipper block, which cooperates with the thread 28 of the screw and which rests, by its spherical convex face 30, against the truncated face 18 of the slipper block.

The screwing of the nut 29 on the thread 28 of the screw does not grip the spherical faces 15 and 22 one against the other but on the contrary is meant to leave an operational clearance J between the said two faces and thus allow not only free relative deflective movements of the different parts, but also a transverse deflection, in the direction of arrow F, of the slipper block 11 with respect to the piston 10.

After the aforesaid screwing, the nut 29 is secured in position on the thread 28 by electron beam welding (24) of the end of the thread.

The conduits 19 and 22 define together an intermediate chamber 31, which the conduits 32, provided in the head 26 of the screw, connect to the central cavity 13 of the piston.

A conduit 33, provided axially through the head 26 and through the stem 25 of the screw, connects the cavity 13 of the piston 10 to the cavity 16 of the slipper block 11.

The operation of the aforedescribed disposition is simple and can be summed up as follows.

Each pair of opposite surfaces, generally resting one against the other, constitutes a "ball and socket" type joint: these are spherical surfaces 15 and 21, the conical face 18 and spherical face 30, and the conical face 20 and spherical face 27.

The relative pivoting movements are, as a result, entirely free, all the more so because of the clearance J.

The conduit 33 naturally enables part of the pressurized hydraulic fluid contained inside the cavity to reach the cavity 16 of the slipper block 11, thus permitting to constitute a film of fluid between the plane face 14 of the slipper block 11 and the plane face 9 of the plate 8.

It was also advantageous to allow the discharge of the fluid contained inside the intermediate chamber 31, and this is done via the conduits 32; thus, all overpressures are avoided in the said chamber 31.

Finally, the coincidence of the centre C of the spherical face 15 and of the centre of gravity G of the slipper block 11, leads to the cancellation of the tilting torque created by the centrifugal forces when the cylindrical-block rotates, together with the pistons 10 and the slipper block 11 coupled thereto, with respect to the casing and to the plate 8.

A number of the details of embodiments can of course have variants. Some of these are shown in the embodiment of FIG. 3 with reference to which the following remarks are made.

The shoulder 20 is constituted by a transverse plane perpendicular to the axis of the piston 10.

A bush 34 is fitted in the bore of the conduit 22 and rests via its flange 35 on the shoulder 20.

The bolt 23 is still present, but it is the screw head 26 which is contained in the cavity 16 of the slipper block 11, the nut 29 being contained in the cavity 13 of the piston 10, whereas it cooperates with the thread 28 of the screw, being relatively locked therein by crimping (36) the flared out end 37 of the stem 25 on to the nut 29.

The nut 29 is resting against the flange 35 and all the faces of the pairs of surfaces in contact are spherical; these are the convex face 15 of the slipper block 11 and the concave face 21 of the piston 10, the convex face 27 of the screw head 26 and the concave face **18*a* of the cavity 16 of the slipper block 11, and the convex face 30 of the nut 29 and the concave face 38 of the bush 34**.

Finally, conduits 39 are provided in the bush 34, which create a communication between the intermediate chamber 31 and the cavity 13 of the piston 10.

Figure 3:
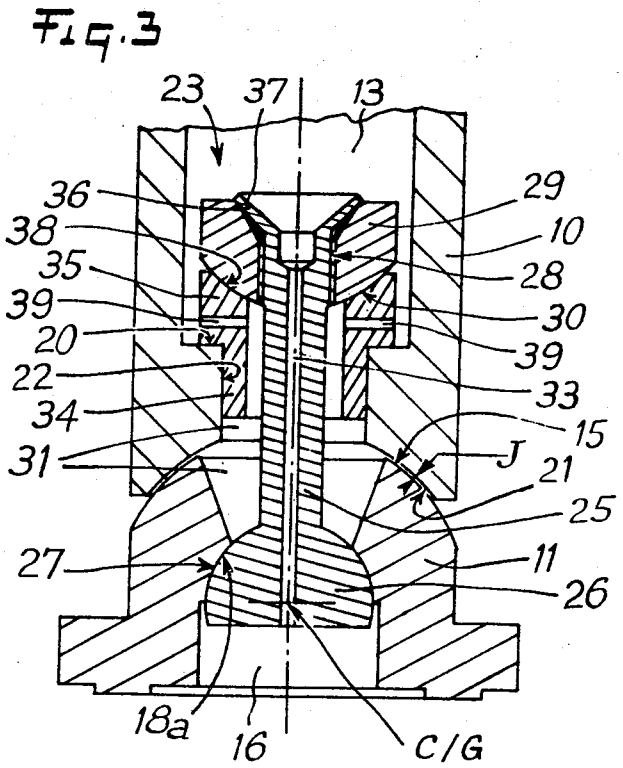
FIG. 3 is a cross-section, similar to that shown in FIG. 2, of a variant according to the invention of the assembly shown in said FIG. 2.

All other dispositions remaining unchanged, it is obvious that the operation, when adopting the variant shown in FIG. 3, is the same as that already described with reference to FIG. 2.

The following advantages are also noted with these two embodiments.

Compensation is provided for any concentricity defects in the parts constituting the assembly.

Possible free pivoting movements for the different parts, reduces their wear, and in particular the wear of the spherical parts.

The possibility of relative displacement (F) of the slipper blocks 11 and piston 10, due to the clearance J, results in, an absence of bending stresses on the screw stem 25, due also to the "ball and socket" type joints which are provided.

The invention is in no way limited to the description given hereinabove but on the contrary covers any variants which can be brought thereto without departing from the scope or the spirit thereof.

What is claimed is:

1. A piston assembly for use in a pressurized fluid mechanism such as a hydraulic pump or motor equipped with pistons which bear against a reaction plate via slipper blocks, said assembly comprising such a piston and the slipper block associated therewith, which slipper block is coupled to one end of said piston by means of a ball-and-socket joint, the male element of said joint comprising that part of said slipper block opposite the face supporting said slipper block on the reaction plate, and the female element of said joint comprising said end of said piston, said piston including a central cavity issuing at its two axial ends and which has, at said piston end comprising said female element of said joint, a through hole formed by a shoulder of smaller cross-section than the adjacent part of said central cavity and said slipper block including an inner cavity open to the reaction plate and a through hole which connects said inner cavity of said slipper block with said male element of said joint, wherein:

a bolt comprising a bolt head and a bolt stem and a nut threaded on said bolt stem hold said slider block to said piston, said stem passes through said through holes and one of said bolt head and said nut is disposed for contact with a supporting surface on said central cavity and the other of said bolt head and nut is disposed for contact with a supporting surface on said inner cavity;

said supporting surfaces for said nut and said bolt head on said inner cavity and said central cavity form ball-and-socket joints with said bolt head and said nut;

said through holes in said piston and said slipper block form an enclosure in said assembly between said slipper block and said piston closed at the ends thereof by said bolt head and nut;

a bore through said bolt stem and bolt head provides hydraulic communication between said central and inner cavities; and said one of said bolt head and nut rests against said shoulder via a bush in said through hole in said shoulder, said bush comprising a head interposed between said shoulder and said bolt head or nut and a pipe connecting said enclosure with said central cavity provided in said bush.

2. Assembly as claimed in claim 1, wherein said nut is assembled on said bolt in such a way as to leave an operational clearance permitting the free relative pivoting of the slider block and piston assembly.

3. Assembly as claimed in claim 1, wherein said nut is electron beam welded on the cooperating end of said bolt.

* * * * *